US005399034A

United States Patent [19]

Fujii et al.

[11] Patent Number: 5,399,034

[45] Date of Patent: Mar. 21, 1995

[54] INK RIBBON CARTRIDGE

[75] Inventors: Toyoko Fujii; Takeshi Nakajima, both of Kanagawa, Japan

[73] Assignee: Sony Corporation, Japan

[21] Appl. No.: 47,499

[22] Filed: Apr. 19, 1993

[30] Foreign Application Priority Data

Apr. 23, 1992 [JP] Japan ..... 4-104157

[51] Int. Cl.[6] ..... B41J 35/28

[52] U.S. Cl. ..... 400/207; 400/208

[58] Field of Search ..... 400/207, 208, 208.1, 400/499

[56] References Cited

U.S. PATENT DOCUMENTS

| | | | |
|---|---|---|---|
| 1,801,496 | 3/1928 | Fleming | 400/499 |
| 2,398,257 | 2/1943 | Schwartz | 156/DIG. 9 |
| 4,622,563 | 11/1986 | Watanabe | 400/208 |
| 4,970,531 | 11/1990 | Shimizu et al. | 400/208 |
| 5,035,325 | 7/1991 | Kitsaki | 400/208 |
| 5,079,565 | 1/1992 | Shimizu et al. | 346/76 PH |

FOREIGN PATENT DOCUMENTS

| | | | |
|---|---|---|---|
| 0381154 | 8/1990 | European Pat. Off. . | |
| 0274971 | 12/1986 | Japan | 400/207 |
| 2758918 | 7/1978 | Sweden | 400/505 |
| 2260516 | 4/1993 | United Kingdom . | |

*Primary Examiner*—Edgar S. Burr
*Assistant Examiner*—Anthony H. Nguyen
*Attorney, Agent, or Firm*—Ronald P. Kananen

[57] ABSTRACT

An ink ribbon cartridge is composed of an ink ribbon unit having an ink ribbon, and a spool member on which the ink ribbon is wound includes a first identifying portion to identify the type of the ink ribbon wound thereon; and a holder to house the ink ribbon unit therein, having a base portion, a pair of wall portions facingly extended from the base portion to support the ink ribbon unit by establishing an engagement therewith, and plurality of second identifying portions to identify the type of the holder having the same appearance as the first identifying portion. The first and second identifying portions may be colored portions. The second identifying portions may be formed in labels adhered on the holder on which a method for housing the spool member into the holder is provided. The ink ribbon unit can be provided from a package on which a third identifying portion having the same color as the first and second identifying portions is formed.

13 Claims, 4 Drawing Sheets

INK RIBBON CARTRIDGE

BACKGROUND OF THE INVENTION

1. Field of the Invention

The present invention relates to an ink ribbon cartridge composed of an ink ribbon holder and an ink ribbon housed therein. Specifically, the present invention relates to an ink ribbon cartridge for a printing device, wherein an ink ribbon being correctly housed in a corresponding ink ribbon holder.

2. Description of the Background Art

Generally, an ink ribbon holder and an ink ribbon housed therein is utilized as an ink ribbon cartridge for a common printing device, such as a thermal printer. The ink ribbon is wound on a supply spool arranged in the ink ribbon holder. The ink ribbon cartridge is inserted from a cartridge insertion opening of the printer. When the printer is operated, the ink ribbon is taken up by a take-up spool arranged adjacent the supply spool in the holder. Detecting means for detecting the ink ribbon cartridge is formed on an inner wall of the cartridge insertion opening of the printer. The ink ribbon holder has holes on a wall at an inner end portion of the holder corresponding to the type thereof. When the ink ribbon cartridge is inserted in the cartridge insertion opening, detecting means detects the type of the cartridge according to holes of the holder, then a thermal head of the printer is controlled according to the detection, e.g., detection of the ink ribbon for black-and white type, color type and over head projector (OHP) type. Yellow portion, magenta portion and cyan portion are respectively formed on the color and the OHP type of the ink ribbon. Axial ends of both the supply spool on which the ink ribbon is wound and the take-up spool are supported by the opposite side walls of the holder.

During operation, the ink ribbon cartridge is inserted in the cartridge insertion opening of a printer body, then, when the ink ribbon is completely used, the ink ribbon cartridge is pulled out therefrom to dispose the ink ribbon with the ink ribbon holder. The number of disposed ink ribbon cartridges becomes quite numerous. This causes environmental pollution.

In order to repeatedly use the ink ribbon cartridge, the ink ribbon is removed from the ink ribbon holder after the ink ribbon cartridge is detached from the printer body to dispose only the used ink ribbon. Then, the new ink ribbon is housed in the detached ink ribbon holder to again insert in the cartridge insertion opening of the printer body.

However, any designation to detect the type of the ink ribbon at a glance is made thereon. Therefore, the ink ribbon cannot be easily identified by an appearance thereof. On the other hand, identification of the ink ribbon holder is done by the holes on the inner wall thereof, so the holder cannot also be easily identified at a glance.

Therefore, the type of the ink ribbon to be housed in the corresponding ink ribbon holder may be frequently mistaken when the ink ribbon holder is repeatedly used.

SUMMARY OF THE INVENTION

It is therefore a principal object of the present invention to provide an ink ribbon cartridge housing an ink ribbon therein which can be repeatedly used.

It is another object of the present invention to provide an ink ribbon cartridge of which an ink ribbon can be correctly housed in a corresponding ink ribbon holder.

It is a further object of the present invention to provide an ink ribbon and an ink ribbon holder which can be easily identified at first glance.

It is furthermore object of the present lo invention to provide an ink ribbon cartridge which can prevent environmental pollution.

According to one aspect of the present invention, an ink ribbon cartridge is composed of an ink ribbon; a spool member including a supply spool for supplying the ink ribbon and a take-up spool for taking up the ink ribbon, and an end portion having a predetermined color; and a holder having a base portion and a pair of wall portions, each of the wall portions being opposite each other for holding the spool member, and having holes into which the end portion of the spool member are inserted. The holder has colored portions being provided the same color as the end portion of the spool member. The colored portions may be located on one of the wall portions, or on the base of the holder. The colored portions may be formed in labels adhered on the holder on which a method for housing the spool member into the holder is provided.

The holder may further include a bias means for biasing the spool member in the direction of one end of the wall portions allowing the spool member to be protruded from the holes of one of the end of the wall portions.

A combination of a package including an ink ribbon and printing paper is composed of an ink ribbon unit having a pair of spools on which the ink ribbon is wound, and an end portion of the pair of spools having a predetermined color, and plural sheet of printing paper. An amount of the paper may be determined so as to correspond to a capacity of the ink ribbon. The package has a color portion being same color as the end portion of the spool member and the colored portions of the holder.

According to the another aspect of the present invention, an ink ribbon cartridge is composed of an ink ribbon unit having an ink ribbon, and a spool member on which the ink ribbon is wound including a first identifying portion to identify the type of the ink ribbon wound thereon; and a holder to receive the ink ribbon unit therein, having a base portion, a pair of wall portions facingly extended from the base portion to support the ink ribbon unit by establishing an engagement therewith, and plurality of second identifying portions to identify the type of the holder having the same appearance as the first identifying portion.

The first and the second identifying portions may be colored portions.

The holder may further include a springing member on one of the wall portions to apply force to the spool member in a direction of the other wall portion. The holder may also have holes on the wall portion so that an end portion of the ink ribbon unit is protruded from the holder by means of the springing member.

The second identifying portions may be located on the outside of one on which the wall portions of the springing member is installed, or on the base portion.

The second identifying portions may be formed in labels adhered on the holder on which a method for housing the spool member into the holder is provided.

The ink ribbon unit can be provided from a package on which a third identifying portion having the same color as the first and second identifying portions is formed.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
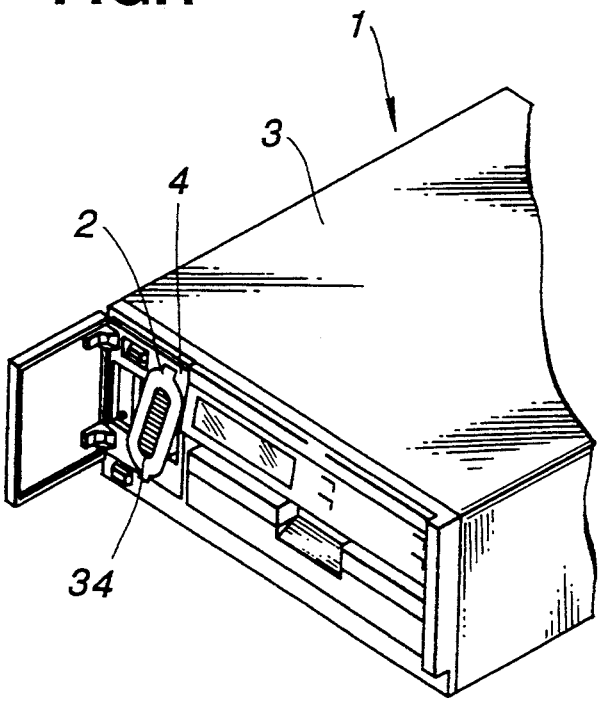
FIG. 1 is a perspective view of a printer including an ink ribbon cartridge according to the present invention to be inserted.
Figure 2:
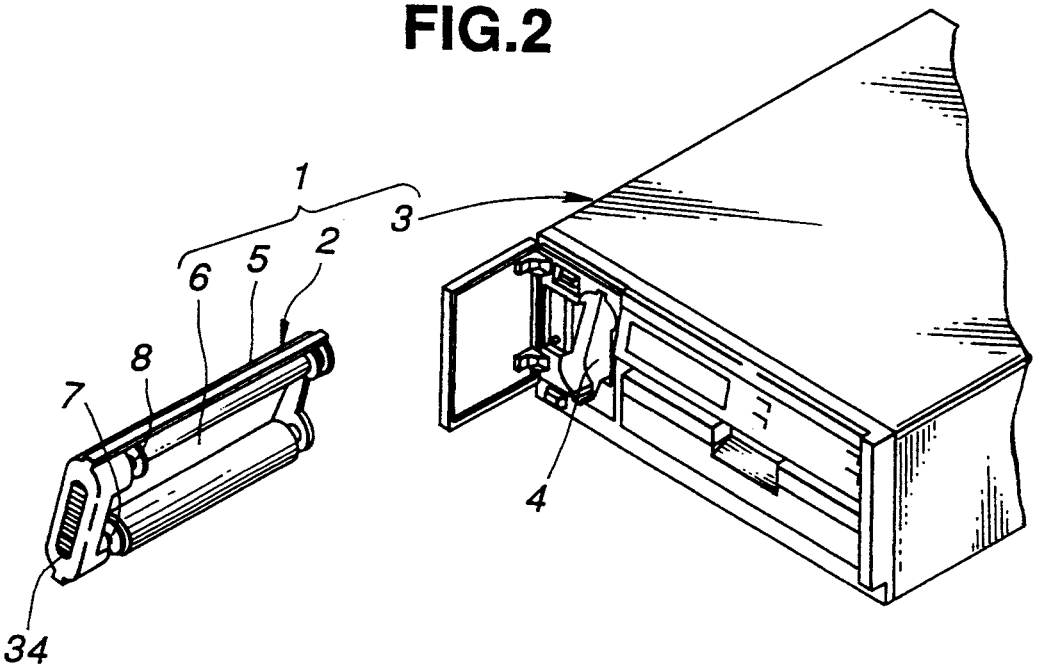
FIG. 2 is a perspective view of a printer body when the ink ribbon cartridge is detached.
Figure 3:
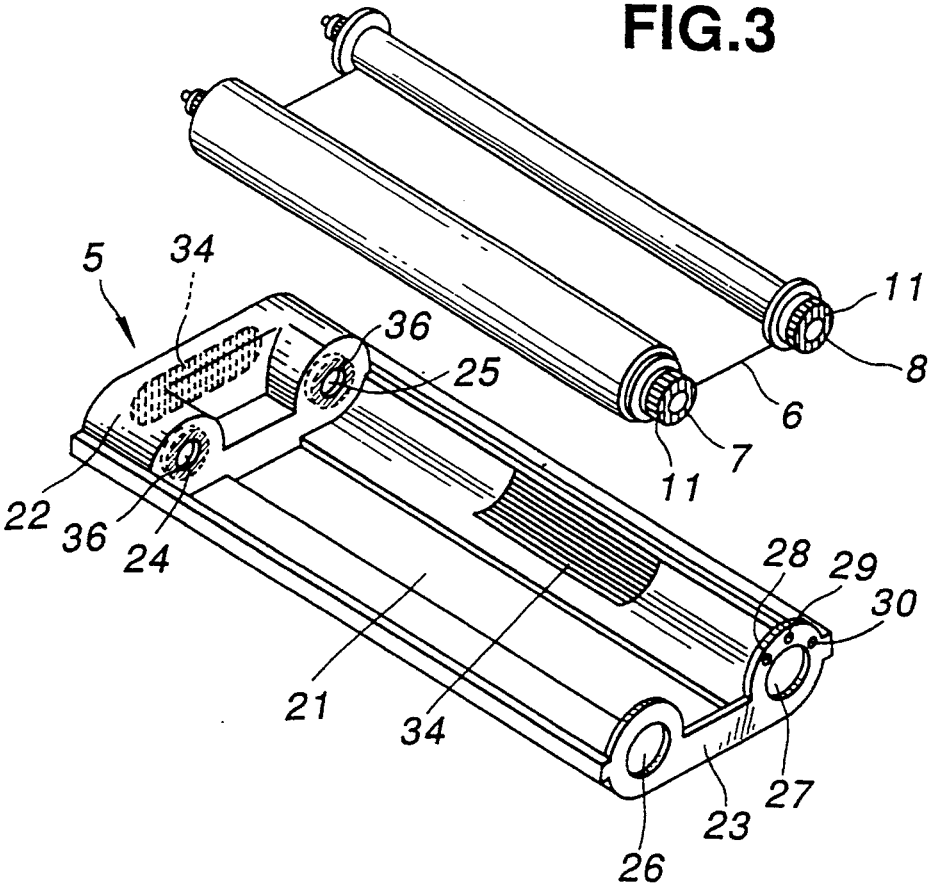
FIG. 3 is a perspective view of an ink ribbon and an ink ribbon holder according to the present invention.
Figure 4:
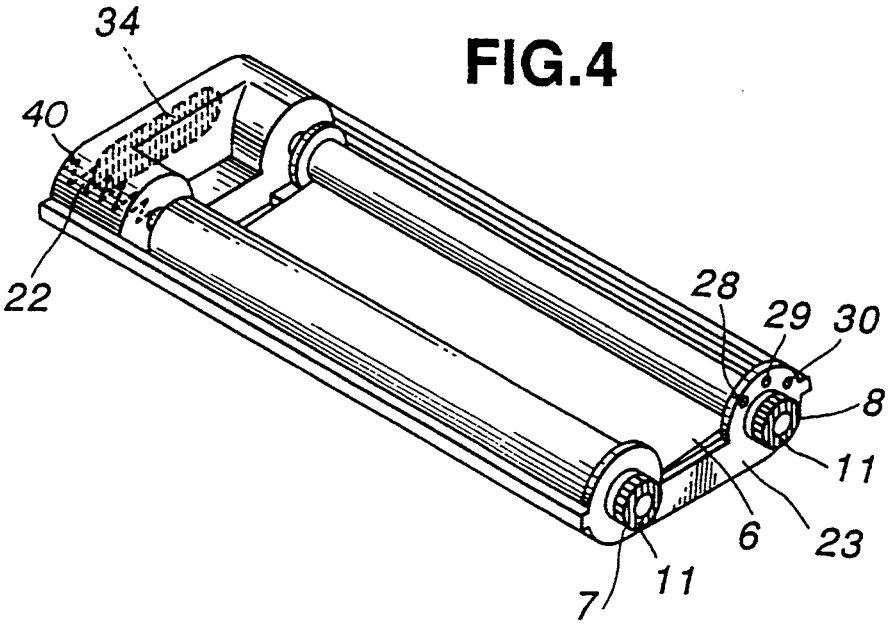
FIG. 4 is a perspective view of the ink ribbon cartridge of the present invention, when the ink ribbon is housed in the ink ribbon holder.

FIGS. 1 and 2 show a typical thermal printer 1. An ink ribbon cartridge 2 is inserted in and detached from a printer body 3 of the printer 1 via a cartridge insertion opening 4 formed thereon to receive the ink ribbon cartridge 2. The ink ribbon cartridge 2 includes an ink ribbon holder 5 and an ink ribbon 6 of a thermal sheet type housed therein. Referring to FIGS. 3 and 4, a supply spool 7 is housed in the ink ribbon holder 5 and a take-up spool 8 is also arranged therein parallel with the supply spool 7. The ink ribbon 6 is wound on the supply spool 7.

The ink ribbon 6 may be selected from the group consisting of the ink ribbons for black-and-white printing, colored printing, and printing for over head projector(OHP) sheets.

One end of the ink ribbon 6 is engaged with the supply spool 7 then wound thereon. Concurrently, the other end of the ink ribbon 6 is engaged with the take-up spool 8 to be taken up thereby. Thus, the ink ribbon 6 wound on the supply spool 7 is pulled out from the spool 7 and taken up by the take-up spool 8.

Two pairs of spool mountings are formed on the inner wall of the cartridge insertion opening 4 of the printer body 3 to rotatably drive the supply and take-up spools 7 and 8. Spool engaging portions are formed in the inner end portion of the supply and take-up spools 7 and 8 to engage with the corresponding spool mountings. When the ink ribbon cartridge 2 is inserted in the cartridge insertion opening 4 of the printer body 3, the spool mountings engage with the both spools 7 and 8, then the spool mountings are rotated to rotate the spools 7 and 8. Thus, the ink ribbon wound on the supply spool 7 is taken up by the take-up spool 8.

Referring to FIG. 3, colored portions 11 are formed on the both spools 7 and 8 at areas of the inner and outer end portions thereof according to the type of the ink ribbon 6 which is wound thereon. For example, colored portion 11 of the spools 7 and 8 on which the ink ribbon for color printing is wound is colored pink, that for black-and-white printing is colored gray, and that for OHP printing is colored blue. Thus, the type of the ink ribbon 6 housed in the ink ribbon holder 5 can be recognized by the color of the colored portion 11 on the spools 7 and 8.

The ink ribbon holder 5 is composed of a bottom plate 21 and an outer support plate 22 supporting outer ends of the supply and the take-up spools 7 and 8, and an inner support plate 23 oppositely arranged to the outer support plate 22 for supporting inner ends of the spools. The outer support plate 22 has spool supporting holes 24 and 25 to receive the outer ends of the supply and take-up spools 7 and 8. Concurrently, the inner support plate 23 has spool supporting holes 26 and 27 respectively at an axially spaced location from the spool supporting holes 24 and 25 are located.

Spool pressing members 36 are mounted on the inner wall of the outer ends of the ink ribbon holder 5 being sprung by springing means 40 toward the direction of the spools 7 and 8 so as to plug spool supporting holes 24 and 25. The outer ends of the supply and the take-up spools 7 and 8 are inserted into the spool supporting holes 24 and 25 to the depth of the holes while pressing the spool pressing members 36 against force applied by the springing means. On the other hand, the inner ends of the spools 7 and 8 are inserted into the spool supporting holes 26 and 27 located on the inner support plate 23. Thus, the supply and the take-up spools 7 and 8 are rotatably installed in the ink ribbon holder 5, and the ink ribbon 6 wound on the supply spool 7 is detachably housed therein.

Figure 5:
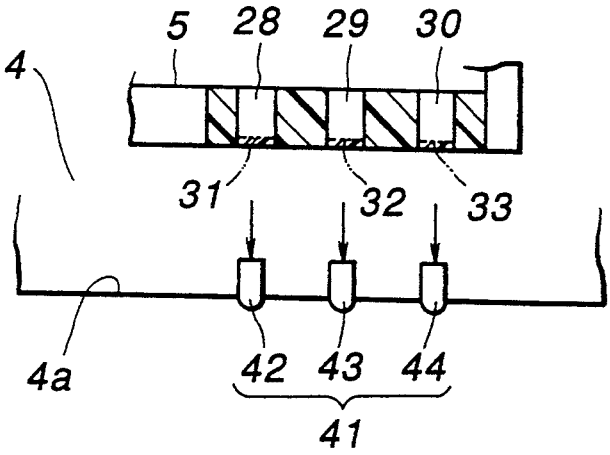
FIG. 5 is an explanation drawing showing a relationship between holes on the ink ribbon holder and detecting means on the printer body.

The support plate 23 of the ink ribbon holder 5 further has first, second and third holes 28, 29 and 30 arranged at the area adjacent the spool supporting hole 27. Referring to FIG. 5, the holes 28, 29 and 30 are individually plugged up according to the type of the ink ribbon holder 5. For example, in the ink ribbon holder 5 for color printing, all holes 28, 29 and 30 are plugged up with block plates 31, 32 and 33, while in that for black-and-white printing, first and second holes 28 and 29 are plugged up with the block plates 31 and 32, and in that for OHP printing, first and third holes 28 and 30 are plugged up with the block plates 31 and 33.

Figure 6:
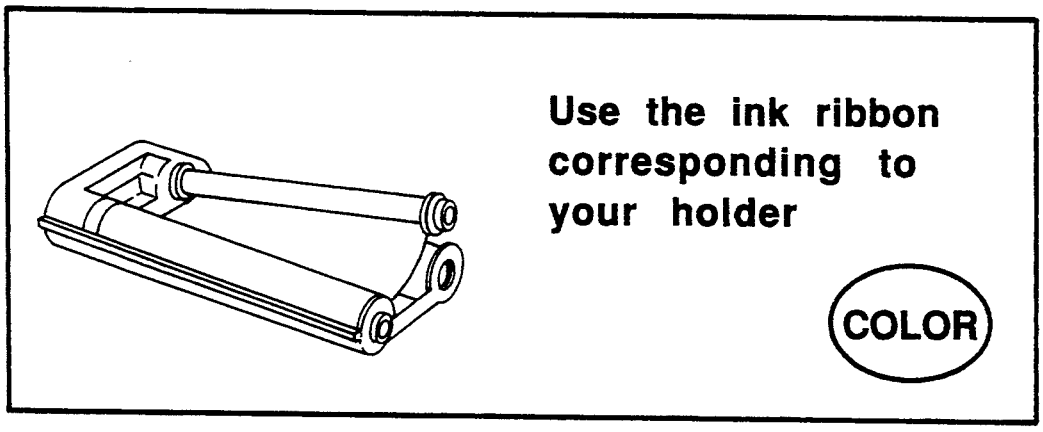
FIG. 6 is a label being adhered on the ink ribbon holder according to the present invention.

Referring again to FIG. 3, identifying portions 34 are formed on the bottom plate 21 of the ink ribbon holder 5, and on the outer surface of the outer support plate 22 corresponding to the type of the ink ribbon to be housed in the holder 5. The identifying portion 34 may be formed by directly coloring the plates 21 and 22 to the same color with the colored portion 11 of the spools, or adhering a label having the same color. When the identifying portion 34 is formed of a label, housing process for housing the spools 7 and 8 with the ink ribbon 6 in the ink ribbon holder 5 may be written on the label, as shown in FIG. 6, to easily and surely house the spools in the holder 5 at a glance of the label.

The ink ribbon cartridge 2 is set to the printer body 3 by being inserted into the cartridge insertion opening 4 of the printer body 3 from the side of the inner support plate 23 of the holder 5.

Detecting means 41 is installed on a bottom surface 4*a* of the cartridge insertion opening 4 of the printer body 3, as shown in FIG. 5, to detect and identify the type of the ink ribbon holder 5 (the ink ribbon cartridge 2) inserted therein. The detecting means 41 is composed of a first, second and third switches 42, 43 and 44 located on the bottom surface 4a corresponding to the areas of the first, second and third holes 28, 29 and 30 are located on the holder 5.

The first, second and third holes 28, 29 and 30 of the ink ribbon holder 5 for color printing are preliminarily plugged up with the block plates 31, 32 and 33. Therefore, when the ink ribbon cartridge 2 housing the ink ribbon 6 for color printing is inserted in the cartridge insertion opening 4, the first, second and third switches 42, 43 and 44 of the detecting means 41 are all pressed by the block plates 31, 32 and 33. Thus, the ink ribbon cartridge 2 inserted is detected as that for color printing. Then, a thermal head of the printer 1 is controlled according to identification.

The first and second holes 28 and 29 of the ink ribbon holder 5 for black-and-white printing are preliminarily plugged up with the block plates 31 and 32. Therefore, when the ink ribbon cartridge 2 housing the ink ribbon 6 for black-and-white printing is inserted in the cartridge insertion opening 4, the first and second switches 42 and 43 of the detecting means 41 are pressed by the block plates 31 and 32. Thus, the ink ribbon cartridge 2 is detected as that for black-and-white printing. Then, a thermal head of the printer 1 is controlled according to identification.

The first and third holes 28 and 30 of the ink ribbon holder 5 for OHP printing are preliminarily plugged up with the block plates 31 and 33. Therefore, when the ink ribbon cartridge 2 housing the ink ribbon 6 for OHP printing is inserted in the cartridge insertion opening 4, the first and third switches 42 and 44 of the detecting means 41 are pressed by the block plates 31 and 33. Thus, the ink ribbon cartridge 2 is detected as that for OHP printing. Then, a thermal head of the printer 1 is controlled according to identification.

Figure 7:
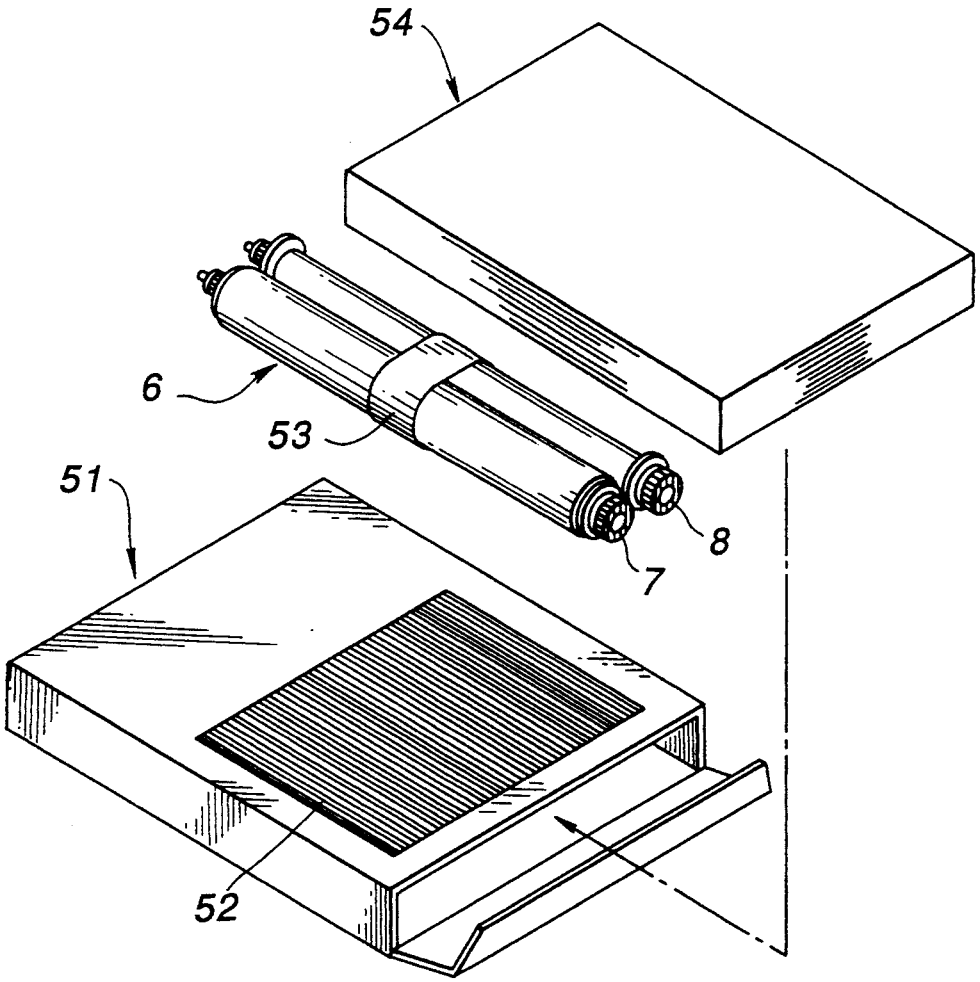
FIG. 7 is a perspective view of an ink ribbon package, wherein plurality of units composed of a supply spool on which the ink ribbon is wound and a take-up spool are packed therein.

Referring now to FIG. 7, an ink ribbon package 51 is prepared to have a box structure, and a colored portion 52 is formed on the surface thereof to recognize the type of an ink ribbon unit, including the ink ribbon 6, the supply spool on which the ink ribbon 6 is wound, and the take-up spool engaging the open end of the ink ribbon 6, housed therein. The supply and the take-up spools 7 and 8 are tied up by a binding tape 53 with the ink ribbon 6 wound on the supply spools 7 for newly use. Appropriate numbers of sheets of printing papers 54 for the ink ribbons capacity packed therein are housed with the units bounded to sale as a package for printing.

When the ink ribbon 6 is fully used, the ink ribbon cartridge 2 is detached from the printer body 3. The ink ribbon 6 is removed from the ink ribbon holder 5, then the new ink ribbon is housed therein. Here, even if the used ink ribbon 6 has been removed, the type of the ink ribbon holder 5 can be easily recognized because the identifying portions 34 indicating the correct type of the holder 5 are on the ink ribbon holder 5.

Here, the ink ribbon 6 having the colored portion 11 colored the same color as the identifying portion 34 of the corresponding ink ribbon holder 5. Therefore, the correct ink ribbon 6 can be housed in the ink ribbon holder 5 without fail.

Thus, when the ink ribbon holder 5 in which the new ink ribbon 6 is housed is inserted in the cartridge insertion opening 4 of the printer body 3, the type of the ink ribbon holder 5 and the ink ribbon 6 are automatically detected by a relationship between holes 28, 29 and 30 arranged on the inner support plate 23 of the holder 5 and detecting means 41 of the printing body 3. The engaging portions, formed at the inner end surface of the supply and take-up spools 7 and 8, are engaged with the spool mountings (not shown in figures), then the spools 7 and 8 are rotatably driven thereby.

During operation, the type of the ink ribbon holder 5 and the ink ribbon 6 inserted in the cartridge insertion opening 4 can be again recognized by the color of the identifying portion 34 on the outer side surface of the outer support plate 22 which can be seen from the outside of the printer 1.

According to the present invention, The type of the ink ribbon to be housed in the corresponding holder can be easily identified at a glance of the color of the colored portion on the spools, because the type of the spools on which the ink ribbon is wound and the corresponding ink ribbon holder are indicated by the same color. Thus, the correct ink ribbon corresponding to the ink ribbon holder can be installed therein without fail.

The type of the ink ribbon inserted in the printer body can also be easily recognized by the color of the identifying portion formed on the outer side surface of the ink ribbon holder.

Additionally, the identifying portion can be easily applied to the holder at a curved area when the portion is formed as a label.

The spools on which the ink ribbon is wound can be surely and easily housed in the ink ribbon holder because housing process is written on each identifying portion of the holder.

The colored portion of the spool is formed at the end portion thereof. Therefore, the colored portion is projected from the spool supporting hole of the holder when housing. Thus, the type of the ink ribbon can be recognized from the outside of the ink ribbon holder supporting the spools on which the ribbon is wounded.

Further to say, when purchasing the ink ribbon, the type thereof is not mistaken because the type of the ink ribbon to be housed in the ink ribbon holder can be easily recognized by the color of the colored portion formed on the surface of the package.

While the present invention has been disclosed in terms of the preferred embodiment in order to facilitate better understanding of the invention, it should be appreciated that the invention can be embodied in various ways without depending from the principle of the invention. Therefore, the invention should be understood to include all possible embodiments and modification to the shown embodiments which can be embodied without departing from the principle of the inventions as set forth in the appended claims.

What is claimed is:

1. An ink ribbon cartridge for use with a printing device, comprising:

an ink ribbon;

a spool assembly comprising a supply spool for supplying said ink ribbon, and a take-up spool for taking up said ink ribbon, at least one of said spools having a colored end portion of a predetermined color indicative of a characteristic of said ink ribbon; and a holder having a base portion and a pair of wall portions, each of said wall portions being opposite each other for holding said spool assembly, and having holes into which said end portion of said spool assembly is inserted, said holder having a colored portion of the same color as said end portion of said spool assembly for matching said holder with said ink ribbon, and means on said holder to be detected by a printing device for identifying the type of ribbon therein.

2. The ink ribbon cartridge according to claim 1, wherein said colored portion of said holder is located on one of said wall portions.

3. The ink ribbon cartridge according to claim 1, wherein said colored portion of said holder is located on said base portion.

4. The ink ribbon cartridge according to claim 1, wherein said colored portion of said holder includes at least one label adhered on said holder.

5. A combination of a package, an ink ribbon unit, a holder for an ink ribbon cartridge and printing paper, comprising:

said ink ribbon unit having a pair of spools on which an ink ribbon is wound, said ink ribbon unit having means for removably mounting said unit into said holder of an ink ribbon cartridge, and an end portion of said pair of spools having a predetermined color indicative of a characteristic of said ink ribbon; and plural sheets of printing paper, an amount of which corresponds to a capacity of said ink ribbon;

said package and said holder each having a color portion of the same color as said end portion of the pair of spools.

6. An ink ribbon cartridge comprising:

an ink ribbon unit having an ink ribbon and a spool member on which said ink ribbon is wound, said spool member including a first identifying portion to identify the type of said ink ribbon wound thereon; and a holder to house said ink ribbon unit therein, said holder having a base portion, a pair of wall portions facingly extended from said base portion to support said ink ribbon unit by establishing an engagement therewith, a second identifying portion on said holder to identify the type of said holder, said second identifying portion having the same appearance as the first identifying portion, and means on said holder to be detected by a printing device for identifying the type of ribbon therein.

7. The ink ribbon cartridge according to claim 6, wherein said first and second identifying portions are colored portions.

8. The ink ribbon cartridge according to claim 6, wherein said holder further includes a spring member on one of said wall portions to apply force to said spool member in a direction of the other wall portion.

9. The ink ribbon cartridge according to claim 8, wherein said holder includes holes on said other wall portion so that an end portion of the ink ribbon unit is protruded from said holder by means of the spring member.

10. The ink ribbon cartridge according to claim 6, wherein said second identifying portions are located on the outside of one of said wall portions.

11. The ink ribbon cartridge according to claim 6, wherein said second identifying portions are located on said base portion.

12. The ink ribbon cartridge according to claim 6, wherein said second identifying portions are labels adhered on said holder.

13. The ink ribbon cartridge according to claim 6, further comprising a package on which a third identifying portion having the same color as the first and second identifying portions is formed.

* * * * *